US005878983A

United States Patent [19]

Olson et al.

[11] Patent Number: 5,878,983

[45] Date of Patent: Mar. 9, 1999

[54] LOAD LEVELING ASSEMBLY

[75] Inventors: William J. Olson, Barrington; Thomas W. Carlson, LaGrange, both of Ill.

[73] Assignee: Illinois Tool Works Inc., Glenview, Ill.

[21] Appl. No.: 540,477

[22] Filed: Oct. 10, 1995

[51] Int. Cl.[6] ..... F16M 11/24

[52] U.S. Cl. ..... 248/188.4; 248/188.2

[58] Field of Search ..... 248/677, 166, 248/188.2, 188.4, 188.8

[56] References Cited

U.S. PATENT DOCUMENTS

| | | | |
|---|---|---|---|
| 3,750,989 | 8/1973 | Bergeson | 248/188.2 |
| 4,199,123 | 4/1980 | Weber et al. | 248/188.2 |
| 4,436,268 | 3/1984 | Schriever | 248/188.2 |
| 4,858,865 | 8/1989 | Schrepfer | 248/188.2 |

*Primary Examiner*—Ramon O. Ramirez
*Assistant Examiner*—Willie Berry, Jr.
*Attorney, Agent, or Firm*—Schwartz & Weinrieb

[57] ABSTRACT

A load leveling foot assembles with a panel for adjusting the height of the panel relative to a support surface. The load leveling foot comprises a foot body, a pivot portion projecting from the foot body for engagement with the panel, a base portion located on the foot body spaced apart from the pivot portion for engagement with a support surface, and an actuator-engaging portion located on the foot body spaced apart from the pivot portion and from the support portion. The actuator portion is configured for engagement with an actuator for pivoting the foot about the pivot portion in such a manner that the base portion rotates relative to the pivot portion so as to increase the distance between the base portion and the panel when the foot body is pivoted in one direction and to decrease the distance between the base portion and the panel when the foot body is pivoted in an opposite direction.

18 Claims, 4 Drawing Sheets

FIG. 8
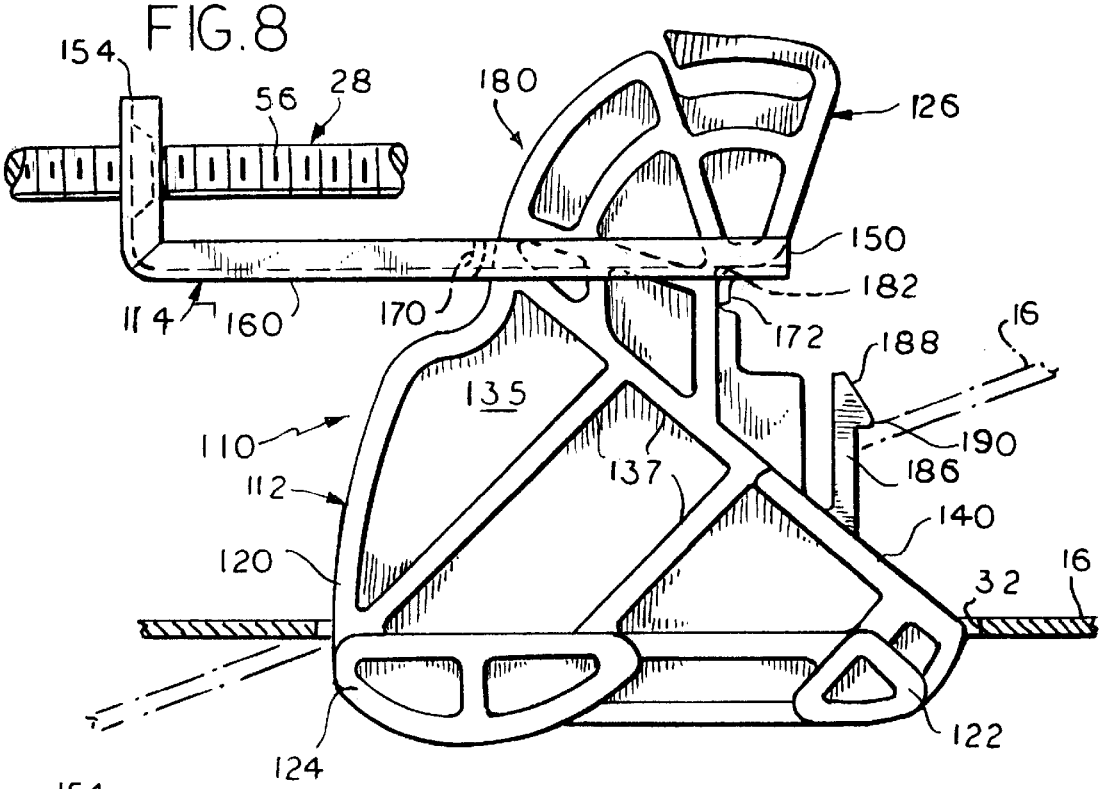
FIG. 9
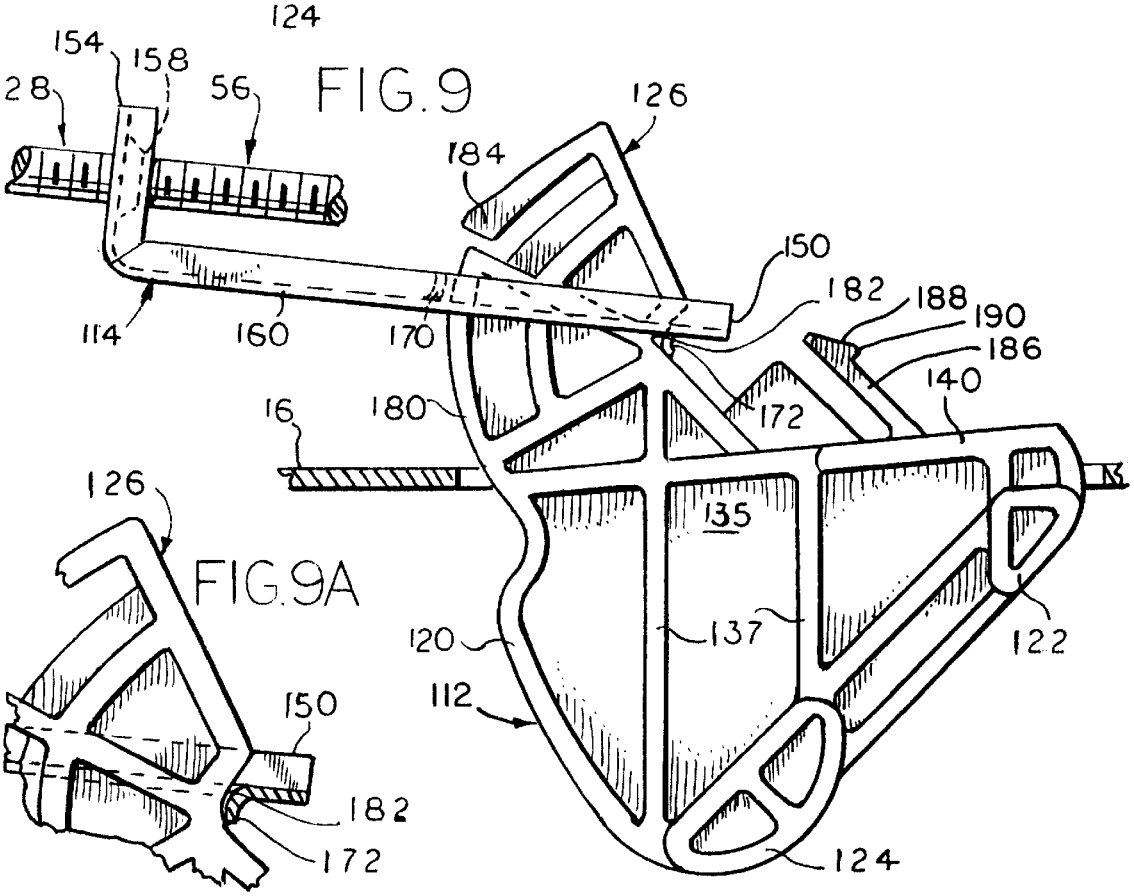
FIG. 9A

LOAD LEVELING ASSEMBLY

FIELD OF THE INVENTION

This invention is directed to a load leveling assembly, and more particularly to a novel load leveling foot and adjusting clip for adjusting the height of an object relative to a support surface.

BACKGROUND OF THE INVENTION

The invention is particularly illustrated and described herein with reference to the problem of adjusting the height, relative to a support surface such as a floor, of one or more points along a bottom surface of a large appliance such as a dishwasher to achieve leveling of the dishwasher. The invention may find other applications in the leveling or adjusting of the height or other distance of other things relative to a floor or other support surface.

It is generally desirable for large appliances such as dishwashers and the like to be leveled upon installation to assure optimal operation. Generally speaking, in the past such appliances have been provided with one or more adjustable legs located generally adjacent corners thereof for accomplishing this leveling. That is, a given floor or other surface upon which the appliance is to be supported may or may not be in a flat and level condition. As such, it is necessary to provide height adjustment mean at one or more corners of the appliance to achieve a level condition of the appliance.

In the past, one of the more commonly used forms of adjustable legs or feet has been a foot mounted to an upwardly projecting threaded shank which threadably engages a threaded slot formed in an undersurface of the appliance. As such, the appliance must usually be additionally supported by some other means while the adjustable foot is manually accessed for adjusting the extent of projection thereof from the bottom or undersurface of the appliance. In the case of relatively large appliances, this process can be somewhat cumbersome and inconvenient. On the other hand, attempting to raise the level of one corner of the appliance by simply rotating this foot may be quite difficult due to the large amount of weight being brought to bear upon the foot and/or the relatively small space usually provided for access to the foot between the appliance lower surface and the floor or other support surface.

Moreover, the use of such a threaded shank requires that some provision be made in the bottom panel of the appliance for providing an internal thread of sufficient strength to accommodate this threaded shank portion of the adjustable foot while bearing a substantial portion of the weight of the appliance. However, relatively thin stamped metal panels or metal support rails are usually utilized as the undersurfaces of such appliances, such that it can be difficult to form a threaded aperture therethrough adequate for this purpose. For example, such panels lend themselves more readily to simple punching operations rather than to thread forming operations as such.

As an additional matter, such load leveling feet are most commonly provided at a rear corner portion of the appliance, such that if the appliance stands against a wall as is often the case, access to this rear foot for purposes of adjustment for leveling can be somewhat cumbersome and difficult.

OBJECTS OF THE INVENTION

Accordingly, it is a general object of the invention to provide a novel and improved load leveling foot which overcomes the above-noted problems.

A more particular object is to provide a load leveling foot which requires but a simple aperture in a panel for assembly therewith and which may be relatively simply and easily assembled to the panel.

A further object is to provide a load leveling foot in accordance with the foregoing objects which is designed to be adjustable from a remote location, such as a front surface of the appliance, even though the foot itself may be positioned adjacent a rear corner or surface portion of the appliance.

A related object is to provide a load leveling foot and related assembly which is relatively simple to assemble and operate and yet highly reliable in operation over a long service life.

SUMMARY OF THE INVENTION

Briefly, and in accordance with the foregoing objects, the invention provides a load leveling foot for assembly with a member for adjusting the distance of at least a portion of the member from a support surface, the load leveling foot comprising: a foot body; a pivot portion projecting from the foot body for engagement with a member; a base portion located on the foot body spaced apart from the pivot portion for engagement with a support surface; and an actuator-engaging portion located on the foot body spaced apart from the pivot portion and from the support portion and configured for engagement with an actuator for pivoting the foot about the pivot portion in such a manner that the base portion is rotatable relative to the pivot portion so as to increase the distance between the base portion and the member when the foot body is pivoted in one direction and to decrease the distance between the base portion and the member when the foot body is pivoted in an opposite direction.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements, throughout the several views and in which:

FIG. 8 is a side elevation, similar to FIG. 1, illustrating a load levelling foot and adjusting clip in accordance with a second embodiment of the invention;

FIG. 9 is a side elevation, similar to FIG. 8, showing a rotated position of the foot for maximum height adjustment;

FIG. 9A is a fragmentary view showing additional details of a portion of FIG. 9;

DETAILED DESCRIPTION OF THE ILLUSTRATED EMBODIMENT

Figure 1:
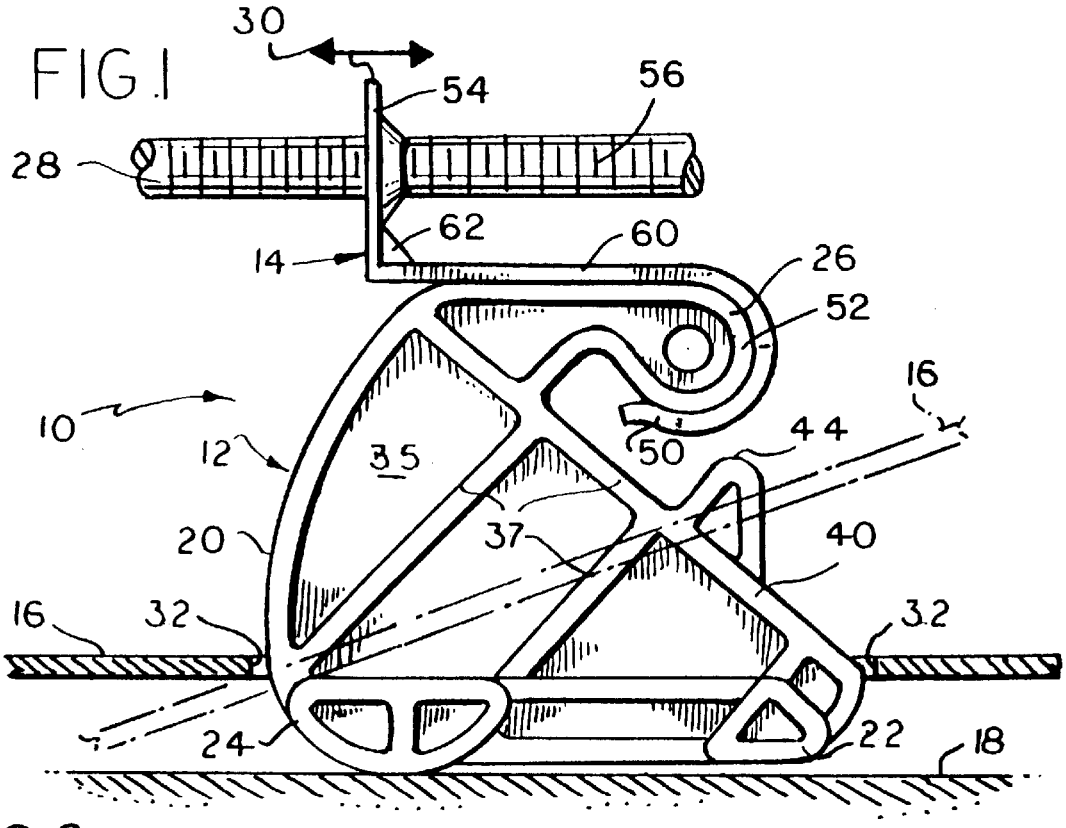
FIG. 1 is a side elevation, partially in section, illustrating a load leveling foot and adjusting clip in accordance with the invention.
Figure 2:
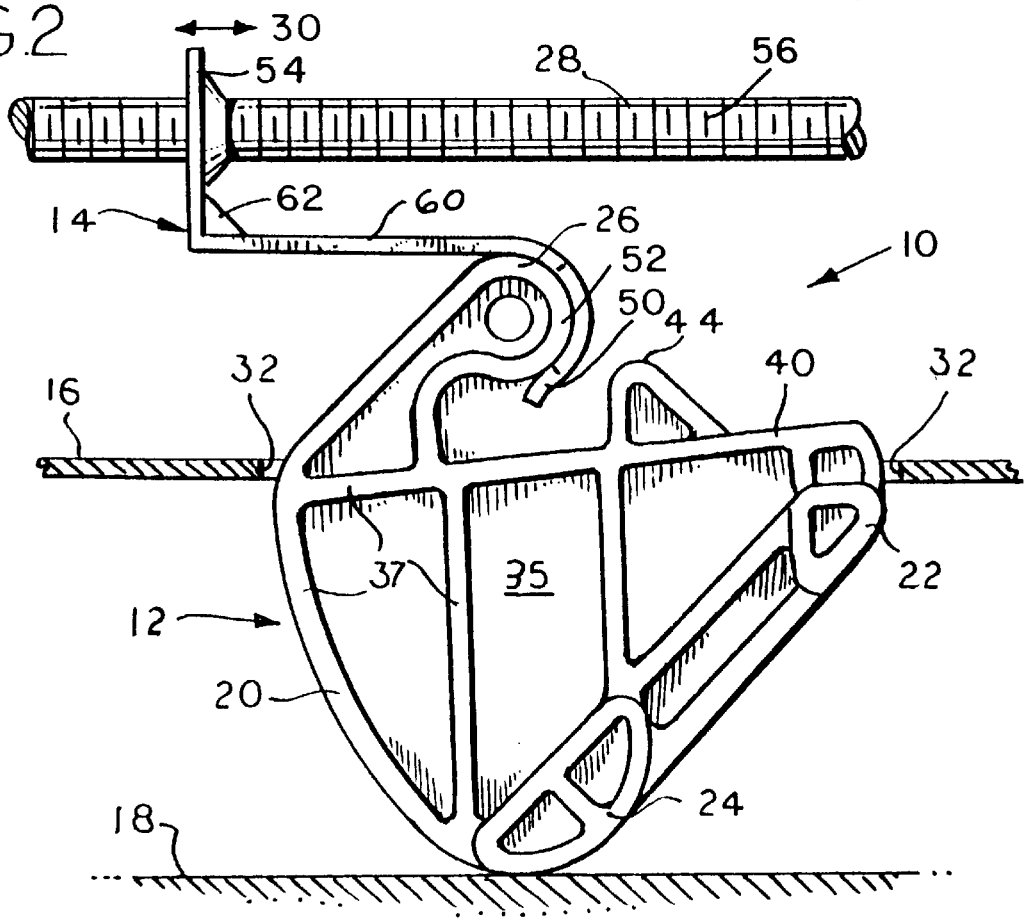
FIG. 2 is a side elevation, similar to FIG. 1, showing a rotated position of the foot for maximum height adjustment.

Referring now to the drawings, and initially to FIGS. 1 and 2, a load leveling assembly in accordance with the invention is designated generally by the reference numeral 10. The assembly 10 includes a load leveling foot 12 and an adjusting clip 14 which is operatively coupled with the foot 12 for adjusting the height of a portion of a panel 16 relative to a support surface or floor 18. Generally speaking, the foot 12 comprises a foot body 20, a pivot portion 22 projecting from the foot body 20 for engagement with the panel 16, and a base portion 24 located on the foot body 20 spaced from the pivot portion 22 for engagement with the support surface 18. An actuator engaging portion 26 is located on the foot body 20 spaced from both the pivot portion 22 and the base portion 24, and is of complementary form for engagement with an actuator, which in the illustrated embodiment includes the adjusting clip 14. The pivot portion 22, the base portion 24 and actuator-engaging portion 26 are respectively located on the foot body 20 such that they define a triangle.

In the embodiment illustrated, the adjusting clip 14 is in turn engaged by an elongate threaded rod 28 for moving the clip 14 bi-directionally in directions as generally indicated by the arrow 30. Responsive to this movement of the clip 14 in the directions indicated by the arrow 30, the foot 12 will move between the position shown in FIG. 1 and the position shown in FIG. 2. The former position adjusts the panel 16 to the minimum height relative to surface 18, while the latter position (FIG. 2) achieves the maximum height of panel 16 relative to surface 18.

It should be noted in this regard that the foot 12 pivots about the pivot member or portion 22 in a direction for increasing the distance between t base portion 24 and the panel 16 when the foot body 20 is pivoted in a generally counterclockwise direction relative to the pivot member 22 as viewed in FIGS. 1 and 2, and for decreasing this distance when the foot body 20 is rotated in the opposite or clockwise direction. It should be noted that during this pivoting motion, the pivot portion 22 provides a pivot point in contact with the panel 16, while the other parts of the foot body 20 including the actuator-engaging portion 26 rotate or pivot about the pivot portion 22. Thus, for example, the position of the threaded rod 28 relative to the panel 16, at least at the point at which it is joined to the adjusting bracket 14, will also vary as the foot body 20 is rotated.

Figure 3:
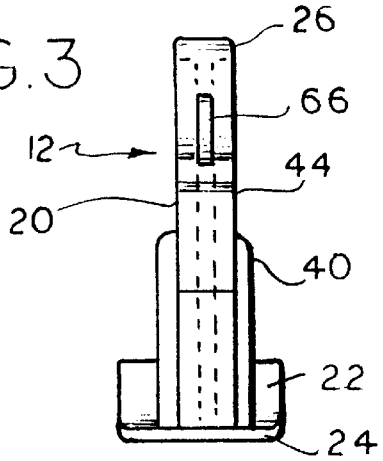
FIG. 3 is an end elevation of the foot of FIGS. 1 and 2.
Figure 4:
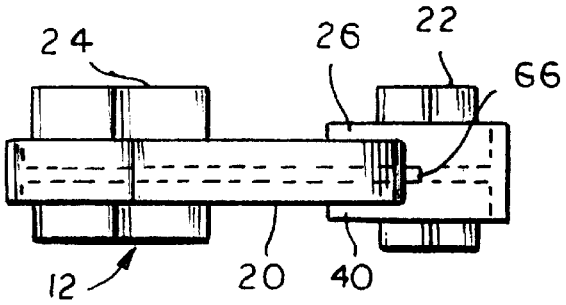
FIG. 4 is a top plan view of the foot.
Figure 7:
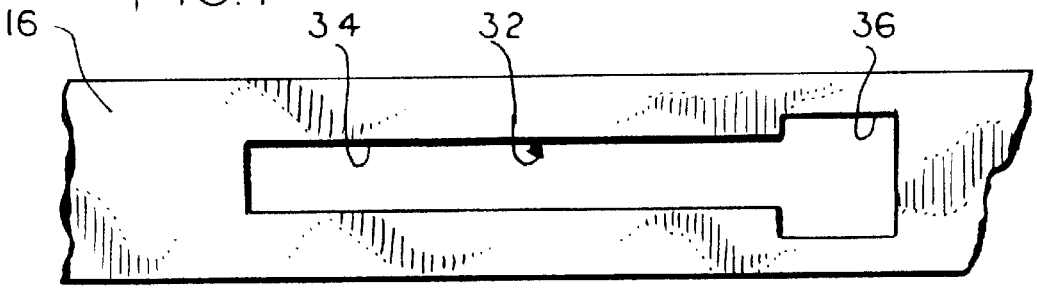
FIG. 7 is a top plan view of a T-shaped slot in a panel, with which the foot of the invention is assembled in the illustrated embodiment.
Figure 10:
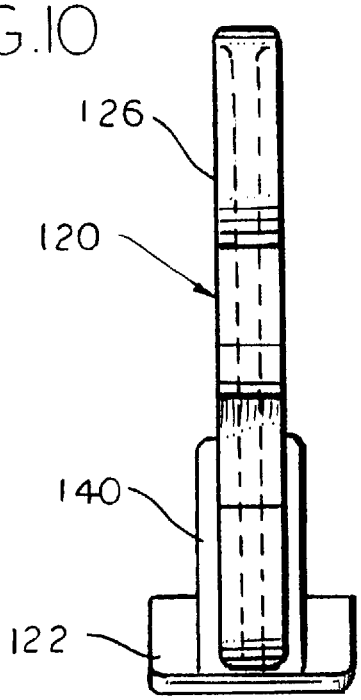
FIG. 10 is an end elevation of the foot of FIGS. 8 and 9.
Figure 12:
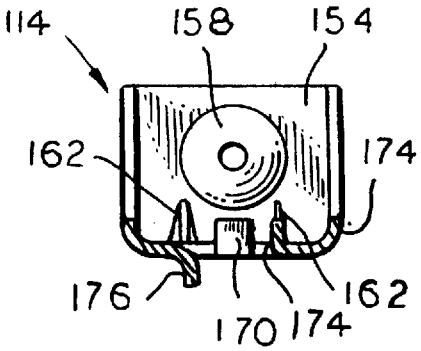
FIG. 12 is an end elevation of the adjusting clip of FIG. 11.
Figure 11:
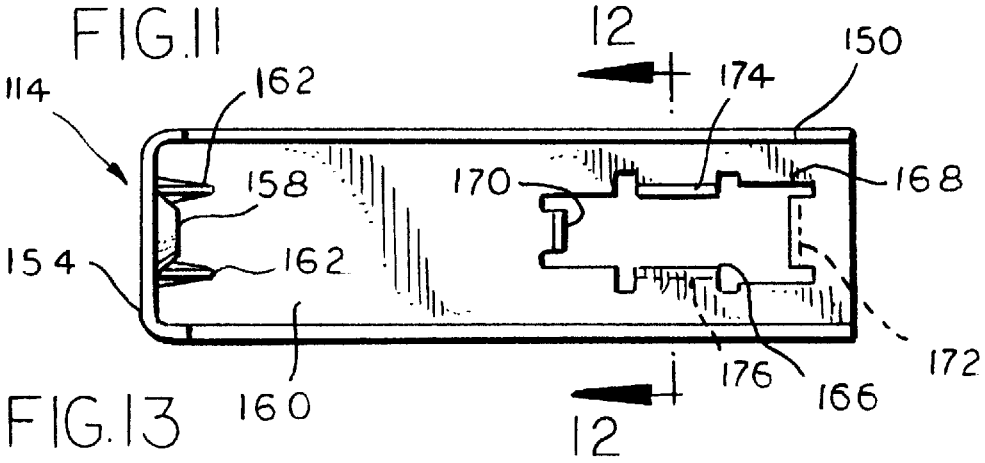
FIG. 11 is a top plan view of the adjusting clip of FIGS. 8 and 9.
Figure 13:
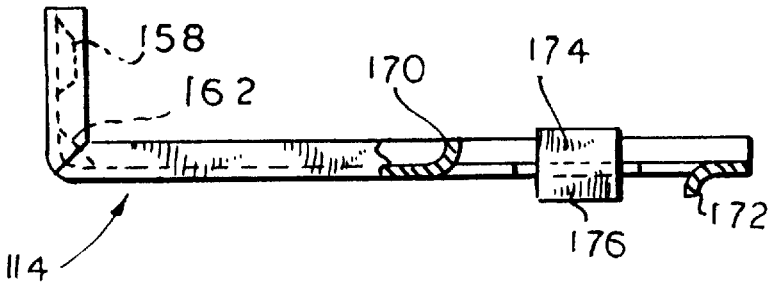
FIG. 13 is a side elevation, partially broken away, of the clip of FIGS. 11 and 12.

Referring also to FIG. 7, the foot 12 is assembled with the panel 16 at a T-shaped slot 32 which is formed through the panel 16. This slot 32 has a smaller or minimum width portion 34 and a larger or maximum width portion 36. As best viewed in FIGS. 3 and 4, it will be seen that the pivot portion 22 and base portion 24 project oppositely outwardly from the foot body 20, being of an increased width. Similarly, an increased width rib portion 40 extends along an outer surface of the foot body 20 from a point generally adjacent the pivot portion 22 in the direction generally of the actuator-engaging portion 26.

The widths of these portions 22, 24 and 40 as well as the width of the remaining major portion of the foot body 20 are selected to be of predetermined widths relative to the maximum and minimum widths 36 and 34 of the T-shaped slot 32. In particular, the width of the major portion of the foot body 20 is less than the minimum width 34 of the T-shaped slot. The base portion 24 is of a width greater than the minimum width 34 of the T-shaped slot, and in the illustrated embodiment is of the same width as the pivot portion 22, namely a width greater than the maximum width 36 of the T-shaped slot 32. The rib portion 40 has a width intermediate the minimum and maximum widths 34, 36 of the T-shaped slot 32. In the illustrated embodiment, the foot body 20 comprises a somewhat thinner web portion 35 and a gridwork or lattice 37 which is thicker than the web portion 35.

The rib portion 40 is located and configured such that it is initially able to be introduced through the maximum width portion 36 of the T-shaped slot 32 (preferably when the base portion 24 is out of engagement with the support surface 18) with the foot body 20 rotated to an orientation relative to the position of the panel 16 as indicated generally in phantom line in FIG. 1. It will be appreciated that the remaining major portion of the foot body 20, being of smaller width than the lesser width 34 of the T-shaped slot 32 will readily pass therethrough for assembly purposes. The adjusting clip 14 is preferably of like width to the major portion of the foot body 20 and therefore may be assembled therewith prior to introducing the same through the T-shaped slot 32. The base portion 24 and pivot portion 22 will of course abut the panel 16 about the T-shaped slot 32, since they are too wide to pass therethrough.

However, following this assembly of the foot 12 relative to the T-shaped slot 32, the foot 12 is rotated somewhat, such that the rib 40 will prevent the foot 12 from passing back outwardly through the T-shaped slot 23. The increased width of the pivot portion 22 and base portion 24 will prevent these portions from passing upwardly through the slot 32 and retain them at the opposite side of the slot 32. Thus, the pivot portion 22 will be positioned for pivotal engagement with the material of the panel 16 about the slot 32 while the base portion 24 may move from a position in engagement with the panel 16 about the slot 32 as shown in FIG. 1 to a maximum extended position as illustrated in FIG. 2. In operation, the engagement of the base portion 24 with the support surface 18, as well as the engagement of the adjusting bracket or clip 14 with the rod 28 will prevent the foot 12 from returning to the orientation relative to the panel 16 as illustrated in phantom line in FIG. 1, wherein the rib 40 may be passed through the maximum width portion 36 of the T-shaped slot 32.

In the illustrated embodiment, the foot 12 also includes a projecting nose portion 44 which is of generally the same width as the major portion of the foot body 20 and projects outwardly from the rib portion 40 at a position therealong spaced remotely from the pivot portion 22. In the illustrated embodiment this nose portion 44 begins at the terminal end of the rib portion 40, that is, at its end farthest from the pivot portion 22, and extends back along the rib 40 a short distance in the direction of the pivot portion 22. This nose portion 44 also serves to limit the position or alignment in which the rib 40 can pass through the maximum width portion 36 of the T-shaped slot 32 when the foot 12 is oriented relative to the panel 16 as illustrated in FIG. 1 in phantom line.

Figure 5:
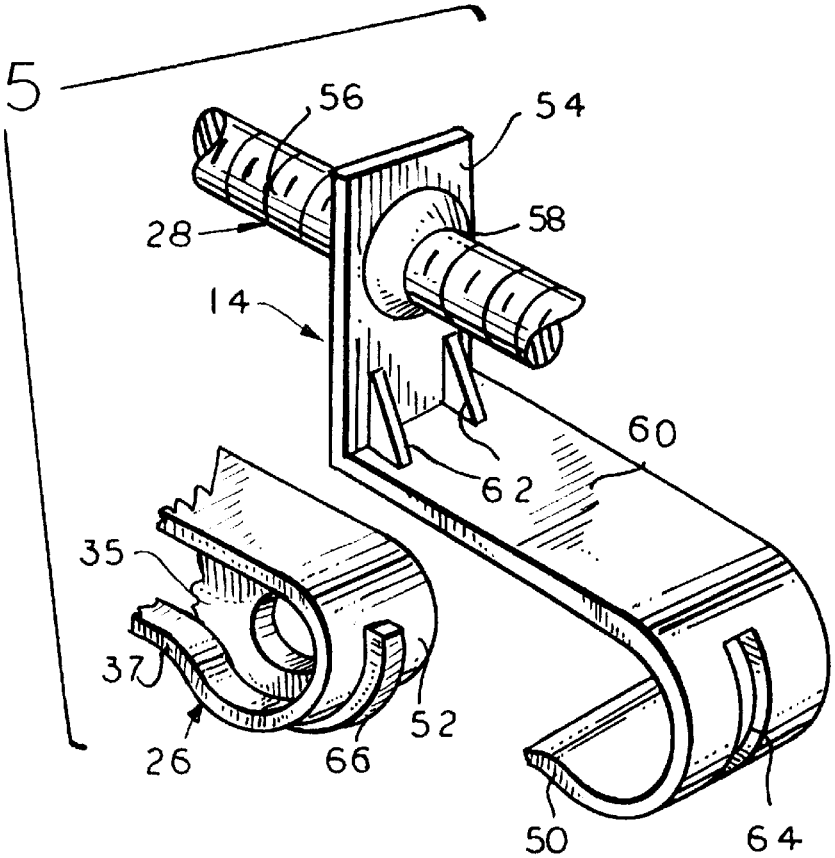
FIG. 5 is a partial perspective view illustrating assembly of the clip with the foot.
Figure 6:
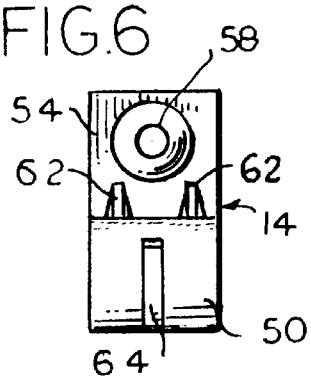
FIG. 6 is an end elevation of the adjusting clip.

Referring now also to FIGS. 5 and 6, the adjusting clip 14 is a generally right angled clip which has a first or foot-engaging portion 50 which is generally semi-circular in configuration for engaging a semi-circular outer surface 52 of the actuator-engaging portion 26 of the foot 12. Thus, the surface 52 may rotate and slide relative to the facing surface of the clip portion 50. The clip 14 also includes a second, rod-engaging portion 54 which is configured for engaging the actuator rod 28. In the illustrated embodiment, this rod 28 has an external thread 56 formed on its outer surface. Cooperatively, the rod-engaging portion 54 is formed with a complementary inside or internal helical thread 58 for threadable engagement with the thread 56 of the rod 28. The rod-engaging portion 54 and foot-engaging portion 50 of the adjusting clip 14 are joined by an elongate intermediate portion 60. The rod-engaging portion 54 is formed at right angles to the intermediate portion 60 and one or more strengthening ribs 62 may be provided therebetween.

In operation, the threaded rod 28 is fixed against axial movement, such that rotation thereof will cause axial movement of the clip 14 in the direction 30. The rod 28 may extend a desired length from the adjusting clip 14, for example, to the front of the dishwasher or other appliance such that it can be rotated to achieve a desired foot height adjustment from such a remote location.

Other arrangements of the rod 28 and clip 14 may be utilized without departing from the invention. For example, the rod might be fixed to the clip 14 and threaded at its remote end, and a fixed, mating nut provided at this remote end, such that rotation of the rod 28 will cause axial motion of the rod 28 and concurrent axial motion of the clip 14 in the direction 30. As another alternative, the rod 28 might be fixed to the clip 14 and its remote end provided with a series of longitudinally spaced notches which meet with a mating surface such as a keyhole slot toward the front of the appliance. Thus, the rod 28 might be adjusted by increments in accordance with the spacing of the longitudinally spaced notches thereon and their engagement with such a keyhole slot.

The foot-engaging portion 50 of the adjusting clip 14 has an elongated arcuate slot 64 formed therein. Cooperatively, the actuator-engaging portion 26 of the foot 12 has a radially projecting generally arcuate rib 66 which is of an angular extent less than that of the slot 64 and is shaped to slidably interfit within the slot 64. The rib 66 and slot 64 cooperate to align the adjusting clip 14 relative to the foot 12, to provide positive retention of the clip 14 in sliding engagement with the foot 12 and to permit a predetermined amount of angular rotation of the foot 12 relative to the clip 14. That is, opposite extremes of the rib 66 provide stop surfaces for opposite ends of the slot 64 as relative rotation occurs between the foot-engaging portion 50 of the clip 14 and the actuator-engaging portion 26 of the foot 12. Preferably, these limits of rotation of the foot 12 relative to the clip 14 are substantially, as shown in FIGS. 1 and 2, respectively.

In operation, then, the movement of the clip 14 in response to rotation or other movement of the rod 28, as discussed above, will cause rotation of the foot 12 about its pivot portion 22 which engages and pivots relative to the panel 16. This movement is also limited by the engagement of the base portion 24 with the floor 18, to define the minimum distance of the panel 16 from the floor 18, as shown in FIG. 1. The maximum distance of the panel 16 from the floor 18 is defined by the maximum rotation of the foot 12 relative to the clip, 14 which is also limited by the abutment of the rib 40 with the panel 16 about the T-shaped slot 32, as is illustrated in FIG. 2.

Referring now to the remaining drawings and initially to FIGS. 8 and 9, a second embodiment of a load levelling assembly comprising a load levelling foot and adjusting clip in accordance with the invention is illustrated. Similar reference numerals are utilized to designate similar parts and components of this embodiment, together with the prefix 1. Accordingly, the assembly is designated generally by reference numeral 110, the foot by reference numeral 112 and the clip by reference numeral 114. The foot 112 cooperates and interfits with respect to the same type of T-shaped slot 32 in a panel 16 as illustrated in FIG. 7. Similarly, the adjusting clip 114 is threadably engaged about the same type of adjusting threaded rod member 28 as shown in FIGS. 1 and 2.

Similar to the embodiment of FIGS. 1 through 7, the foot 112 includes a foot body 120 comprising a web portion 135 and a gridwork or lattice 137 which is thicker than the web portion 135, an outwardly projecting pivot portion 122, a base portion 124 and an increased width rib portion 140 extending generally from the pivot portion 122. The configuration and function of each of these portions is substantially the same as that described for the similar portions shown and described above with reference to FIGS. 1 through 7.

Similar to the clip 14, the adjusting clip 114 comprises a generally right-angled clip which has a foot-engaging portion 150 and a rod-engaging portion 154 which project oppositely outwardly from an intermediate elongate portion 160. The rod-engaging portion 154 is at a right angle to elongate portion 160, and has a through aperture 158 formed for threaded engagement with the threads 56 of the rod 28, in the same manner as the threads 58 of the first embodiment. However, the foot-engaging portion 150 is configured differently from the foot-engaging portion 50 of the embodiment of FIGS. 1 through 7, as will be more fully described hereinbelow.

Departing from the embodiment of FIGS. 1 through 7, the foot 120 has an upwardly projecting actuator-engaging or clip engaging portion 126 which is formed somewhat differently from the actuator-engaging portion 26 of the embodiment of FIGS. 1 through 7 so as to engage the foot-engaging portion 150 of the clip 114.

The latter, foot-engaging portion 150 is configured as a generally flat, planar extension of the clip 114 having a generally rectangular through slot 166. In the illustrated embodiment, this through opening 166 has a somewhat wider end portion 168. Opposite ends of this opening 166 are defined by and provided with oppositely struck-out portions of the material of the clip 114, which form oppositely projecting radiused bends 170 and 172 for slidable engagement with the foot 112 as the same rotates as indicated in FIGS. 8 and 9. In this regard, the relative amount and direction of rotation of the foot 112 is substantially the same as it described with respect to the foot 12 of the embodiment of FIGS. 1 through 7 above. The opening 166 is also provided with similar oppositely struck-out and radiused side portions 174 and 176 to facilitate sliding engagement with the respective opposite lateral sides of the clip-engaging portion 126 of the foot 112.

Cooperatively, the clip-engaging portion 126 of the foot 112 is provided with a curved or radiused surface 180 which slidably engages the radiused bend 170 of the clip 114, and an opposed, short inner radiused surface 182 which engages the radiused bend 172 of the clip 114. Thus, the inner radiused surface 182 and the radiused bend 172 act essentially as a pivot about which the foot 112 may rotate relative to the clip 114 as the clip 114 is respectively advanced or retracted relative to the threaded rod 28, for simultaneously achieving pivoting of the foot body 120 about the pivot 122 relative to the panel 16.

In order to non-removably assemble the clip-engaging portion 126 with the opening 166 of the clip 114, the radiused surface 180 is split or opened at approximately a midportion thereof and formed with a resilient, increased thickness, outwardly projecting cantilevered tab 184 which projects outwardly somewhat of the radiused surface 180. This cantilevered tab 184 is resilient, such that it may be depressed inwardly to allow initial assembly by passing the forward portion of the clip-engaging portion 126 through the opening 166. Thereupon, the resilient portion 184 springs back outwardly of surface 180 thus acting as a stop surface for retaining the foot 112 in engagement with the clip 114.

Also departing from the first embodiment, the nose 44 is replaced by an upwardly projecting cantilevered member 186 which terminates in a ramped portion 188 followed by a shoulder 190. As indicated with respect to the opening 32 in the panel 16 shown in phantom line in FIG. 8, this projecting member 186 will be resiliently bent inwardly to clear the opening 32 by engagement with the ramp surface 188 thereof. Thereupon, this resilient member 186 will snap back into its undeformed position as shown in FIG. 8, whereupon the shoulder portion 190 will oppose opposite rotation thereof with respect to the T-shaped slot 32 beyond its initial point of entry with respect thereto.

In all other respects, the operation of the foot 112 and clip 114 are the same as described hereinabove with respect to the embodiment of FIGS. 1 through 7.

While particular embodiments of the invention have been shown and described in detail, it will be obvious to those skilled in the art that changes and modifications of the present invention, in its various aspects, may be made without departing from the invention in its broader aspect, some of which changes and modifications being matters of routine engineering or design, and others being apparent only after study. As such, the scope of the invention should not be limited by the particular embodiments and specific constructions described herein but should be defined by the appended claims and equivalents thereof. Accordingly, the aim in the appended claims is to cover all such changes and modifications as fall within the true spirit and scope of the invention.

The invention is claimed as follows:

1. A load leveling foot, for assembly with a member, for adjusting the distance of the member from a support surface, comprising:

a foot body;

a pivot portion projecting from said foot body for pivotable engagement with a member whose distance from a support surface is to be adjusted;

a base portion disposed upon said foot body and spaced from said pivot portion for engagement with a support surface relative to which the distance of the member is to be adjusted; and an actuator-engaging portion disposed upon said foot body, spaced from said pivot portion and said base portion, and having means for slidable engagement relative to an actuator for pivoting said load leveling foot about said pivot portion in such a manner that said base portion is rotatable relative to said pivot portion so as to increase the distance between said base portion and the member when said foot body is pivoted in one direction, and to decrease the distance between said base portion and the member when said foot body is pivoted in an opposite direction.

2. A load leveling foot according to claim 1, wherein:

said foot body has a first predetermined width which is less than a second predetermined width of a slot formed within the member for receiving said foot body so as to permit said foot body to move bidirectionally through the slot as said foot body is pivoted about said pivot portion; and said base portion and said pivot portion have a third predetermined width which is greater than said first predetermined width of said foot body and the second predetermined width of the slot so as to prevent said pivot portion and said base portion from passing through the slot defined within the member.

3. A load leveling foot according to claim 2, further comprising:

a rib portion disposed upon said actuator-engaging portion of said foot body for disposition within a slot formed within the actuator so as to movably guide said foot body during said slidable movement of said foot body relative to the actuator.

4. A load leveling foot according to claim 3, wherein:

said actuator-engaging portion of said foot body has an external arcuately-configured surface; and said rib portion is located along said external arcuately-configured surface of said actuator-engaging portion so as to have an arcuate configuration and thereby cause said foot body to undergo pivotable slidable movement with respect to the actuator.

5. A load leveling foot according to claim 2, wherein:

said foot body includes an outwardly projecting resiliently deformable tab portion which is deformable for allowing initial passage of a portion of said foot body through the slot formed within the member for permitting bi-directional passage of said foot body through the slot formed within the member when the member is to be adjusted relative to the support surface, said tab portion being thereafter resiliently returnable to an undeformed condition for preventing removal of said foot body from the member.

6. A load leveling foot according to claim 1, wherein:

said pivot portion, said base portion, and said actuator-engaging portion are located with respect to each other upon said foot body so as to define together a triangle.

7. A load leveling foot according to claim 1, further comprising:

reinforcing ribs disposed within a lattice-gridwork pattern upon side surfaces of said foot body for providing structural strength to said foot body.

8. A load leveling assembly for adjusting the height of a panel relative to a support surface, comprising:

a load leveling foot; and an adjusting clip operatively connected to said load leveling foot;

said load leveling foot comprising a foot body; a pivot portion projecting from said foot body for pivotable engagement with a panel whose height is to be adjusted; a base portion, disposed upon said foot body and spaced from said pivot portion, for engagement with a support surface relative to which the height of the panel is to be adjusted; and an actuator-engaging portion disposed upon said foot body and spaced from said pivot portion and said base portion, and having means for engagement with said adjusting clip; and said adjusting clip comprises a foot-engaging portion for slidably engaging said actuator-engaging portion of said load leveling foot, and a rod-engaging portion for threadedly engaging an actuator rod member for pivoting said load leveling foot about said pivot portion thereof in such a manner that said base portion is moved away from the panel in response to pivoting of said foot body in one direction so as to move the panel away from the support surface, and said base portion is moved toward the panel in response to pivoting of said foot body in an opposite direction so as to move the panel toward the support surface.

9. A load leveling assembly according to claim 8, wherein:

said actuator-engaging portion of said foot body has a semi-circular outer surface; and said foot-engaging portion of said adjusting clip has a semi-circular configuration substantially complementary to said semi-circular outer surface of said actuator-en-gaging portion of said foot body.

10. A load leveling assembly according to claim 9, wherein:

said foot-engaging portion of said adjusting clip has an elongated arcuate slot formed therein and of a predetermined angular extent; and said actuator-engaging portion of said foot body has a radially projecting rib of an angular extent which is less than said predetermined angular extent of said slot, said rib of said foot body and said slot of said adjusting clip cooperating to align said adjusting clip relative to said foot body, to provide positive retention of said adjusting clip in sliding engagement with said foot body, and to define predetermined limits of angular rotation of said foot body relative to said adjusting clip.

11. A load leveling assembly according to claim 8, wherein:

said rod-engaging portion of said adjusting clip projects at rights angles from said foot engaging portion thereof and has an interior helical thread formed thereon for threadable engagement with a complementary outer helical thread formed upon said actuator rod member.

12. A load leveling assembly according to claim 8, wherein:

said foot-engaging portion of said adjusting clip and said actuator-engaging portion of said foot body have cooperating surfaces defining a pivot for pivotal movement of said foot body relative to said adjusting clip.

13. A load leveling assembly according to claim 12, wherein:

said foot-engaging portion of said adjusting clip comprises a projecting surface having a through opening for slidably pivotally receiving said actuator-engaging portion of said foot body, and said actuator-engaging portion of said foot body includes resilient deformable tab means for permitting initial engagement thereof with said through opening in said adjusting clip and thereafter resiliently returning to an undeformed condition so as to oppose removal of said actuator engaging portion of said foot body from said adjusting clip.

14. A load leveling, assembly according to claim 8 wherein said foot-engaging portion of said adjusting clip and said actuator-engaging portion of said foot body have cooperatively slidably engagable surfaces.

15. A load leveling assembly according to claim 8, wherein:

said foot body includes an outwardly projecting resiliently deformable tab portion which is deformable for allowing initial passage of a portion of said foot body through a slot formed within the panel for permitting bi-directional passage of said foot body through the slot formed within the panel when the panel is to be adjusted relative to the support surface, said tab portion being thereafter resiliently returnable to an undeformed condition for preventing removal of said foot body from the panel.

16. A load leveling assembly as set forth in claim 8, wherein:

said pivot portion, said base portion, and said actuator-engaging portion are located with respect to each other upon said foot body so as to define together a triangle.

17. A load leveling assembly as set forth in claim 6, further comprising:

reinforcing ribs disposed within a lattice-gridwork pattern upon side surfaces of said foot body for providing structural strength to said foot body.

18. A load leveling assembly as set forth in claim 8, wherein:

said foot body has a first predetermined width which is less than a second predetermined width of a slot formed within the panel for receiving said foot body so as to permit said foot body to move bi-directionally through the slot as said foot body is pivoted about said pivot portion; and said base portion and said pivot portion have a third predetermined width which is greater than said first predetermined width of said foot body and the second predetermined width of the slot so as to prevent said pivot portion and said base portion from passing through the slot defined within the panel.

* * * * *